US010307332B2

(12) United States Patent
Cheng

(10) Patent No.: US 10,307,332 B2
(45) Date of Patent: Jun. 4, 2019

(54) ADJUSTABLE ACUPOINT AND ORGAN PRESSING DEVICE

(71) Applicant: Chuen Lung Cheng, Hong Kong (HK)

(72) Inventor: Chuen Lung Cheng, Hong Kong (HK)

( * ) Notice: Subject to any disclaimer, the term of this patent is extended or adjusted under 35 U.S.C. 154(b) by 539 days.

(21) Appl. No.: 14/633,096

(22) Filed: Feb. 26, 2015

(65) Prior Publication Data

US 2016/0175192 A1 Jun. 23, 2016

(30) Foreign Application Priority Data

Dec. 19, 2014 (CN) ..... 2014 1 0803284

(51) Int. Cl.
*A61H 39/04* (2006.01)

(52) U.S. Cl.
CPC ..... *A61H 39/04* (2013.01); *A61H 2201/0192* (2013.01); *A61H 2201/1604* (2013.01); *A61H 2201/164* (2013.01); *A61H 2201/1619* (2013.01); *A61H 2203/0456* (2013.01)

(58) Field of Classification Search
CPC .... A61H 2201/0192; A61H 2201/1604; A61H 2201/1619; A61H 2201/164; A61H 2203/0456; A61H 39/04; B25B 5/058; B25B 5/06; B25B 5/067; B25B 5/068; B25B 5/163; B25B 5/166
USPC ..... 606/201–204.55; 269/6, 165, 166
See application file for complete search history.

(56) References Cited

U.S. PATENT DOCUMENTS 4,233,980 A * 11/1980 McRae ..... A61F 5/34 601/148
5,591,201 A * 1/1997 Lam ..... A61B 17/132 5/658
8,357,831 B2 * 1/2013 Buckman ..... A61B 17/135 602/53
2003/0130690 A1 * 7/2003 Porrata ..... A61F 5/0118 606/204
2010/0100120 A1 * 4/2010 Perkins ..... A61B 17/132 606/201
2013/0060277 A1 * 3/2013 D'Andrea ..... A61B 17/08 606/201
2014/0243716 A1 * 8/2014 Diot ..... A61H 1/02 601/5
2016/0066925 A1 * 3/2016 van Sparrentak .... A61B 17/132 606/203

FOREIGN PATENT DOCUMENTS

CN 202909086 U 5/2013

OTHER PUBLICATIONS

1st Office Action of counterpart Chinese Patent Application No. 201410803284.8 dated May 31, 2017.

* cited by examiner

*Primary Examiner* — Martin T Ton

(57) ABSTRACT

An adjustable acupoint and organ pressing device includes a rod, a first pressing member mounted on one end thereof, and an adjustment unit mounted on the other end thereof and provided with a second pressing member facing the first pressing member. The adjustment unit includes a frame and an adjustment handle hingedly connected to the frame with a spring in between. The adjustment unit also includes a fine-adjustment handle hingedly connected to the frame with a fine-adjustment plate and a fine-adjustment spring in between for fine adjustment.

3 Claims, 11 Drawing Sheets

ADJUSTABLE ACUPOINT AND ORGAN PRESSING DEVICE

CROSS-REFERENCE TO RELATED APPLICATIONS

This application claims the benefit of Chinese Patent Application No. 201410803284.8, filed on Dec. 19, 2014, the entire content of which is hereby incorporated by reference.

FIELD OF THE TECHNOLOGY

The present application relates to an adjustable acupoint and organ pressing device.

BACKGROUND

Pressing of acupoints and organs of a human body is an ancient method of physiotherapy. In has long been recorded in books on ancient Chinese medicine that wood, stone and hard bone have been used for acupoint-pressing, pressing, pushing and pulling back and forth to heal diseases of various parts of a human body.

In the 1980s, scientists from various countries used sound, light, electro-thermal, isotope and other biophysics and physiology methods to prove the objective existence of meridians and acupoints in a human body. These acupoints are located in muscle fasciae. Meridians are pathways for the circulation of blood and qi (life energy). Meridians run in all directions throughout a human body and link the acupoints, meridian musculatures and channels to various organs as well as all limbs and bones in the body.

Governing meridians govern the 14 meridians of a human body. They are the Yang meridians that join at the head of the body. The Foot-Taiyang-Bladder meridian is where the acupoints of the vital organs of a human body are located. Further, the wrist is the starting point of the three Yin meridians and the three Yang meridians of the hand. Foot is the starting point of the three Yin meridians and the three Yang meridians of the foot. The 14 meridians cover various parts of the body. They can prevent and heal various diseases and pain of the joints, muscles, nerves, organs and limbs of the body.

Nowadays, there are many healing and healthcare tools. These tools have medical and healthcare functions by making use of anatomy and the meridian system. For example, there are magnetic therapy devices, acupuncture and suction cup devices, body-slapping devices and body-stretching devices, etc. These products require some professional knowledge to operate. For example, they require a user to locate the acupoints on a human body. Furthermore, they are usually directed to a single acupoint or a part of the meridian. These tools do not have a comprehensive medical and healthcare means directed to the entire body, and thus the results of these tools are unsatisfying. These existing medical and healthcare products cannot achieve desired healing effects for diseases. Therefore, there is a need to provide an improved medical and healthcare device.

The above description of the background is provided to aid in understanding the adjustable acupoint and organ pressing device, but is not admitted to describe or constitute pertinent prior art to the adjustable acupoint and organ pressing device, or consider the cited documents as material to the patentability of the claims of the present application.

SUMMARY

An object is to provide an adjustable acupoint and organ pressing device that can carry out pressing of the acupoints and organs of a human body, thereby achieving healing and healthcare effects such as stimulating blood circulation and relaxing muscles and joints, harmonizing blood and life energy, replenishing muscles and bones, relieving pain, diminishing inflammation, etc. The adjustable acupoint and organ pressing device has the advantages of adjusting the pressing force, pressing various acupoints and organs of a human body. Also, it would not affect blood circulation of a human body.

The present application is directed to an adjustable acupoint and organ pressing device including:

(a) a rod;

(b) a first pressing member mounted at a first end of the rod;

(c) an adjustment unit mounted at a second end of the rod; and (d) a second pressing member provided on the adjustment unit and facing the first pressing member;

wherein the adjustment unit may include a frame and a fine-adjustment handle;

the frame may be provided with a first opening for receiving therethrough the rod;

an upper end of the fine-adjustment handle may be hingedly connected to the frame; and the fine-adjustment handle may be formed with a trough for the rod to pass therethrough.

The adjustment unit may further include a fine-adjustment plate and a fine-adjustment spring; the fine-adjustment plate may be mounted between the fine-adjustment handle and the frame and may be formed with a second opening for the rod to pass therethrough; and the fine-adjustment spring may be mounted on the rod between the fine-adjustment plate and the frame for biasing the fine-adjustment plate in a locked position where the second opening of the fine-adjustment plane may be inclined with respect to and engaged with the rod.

The adjustment unit may further include an adjustment handle and an adjustment spring; the adjustment handle may be formed with a third opening for the rod to pass therethrough; an upper end of the adjustment handle may be hingedly connected to the frame; and the adjustment spring may be mounted between the adjustment handle and the frame for biasing the adjustment handle in a locked position where the third opening of the adjustment handle may be inclined with respect to and engaged with the rod.

In an embodiment, the first and second pressing members may be provided with two arc-shaped recessed portions respectively; a first pressing projection protrudes from a recessed surface of the arc-shaped recessed portion of the first pressing member; two second pressing projections protrude from a recessed surface of the arc-shaped recessed portion of the second pressing member; and the first pressing projection may be facing a recessed groove formed between the two second pressing projections.

In an embodiment, the first end of the rod may be provided with a first extension rod perpendicular to the rod, and the first pressing member may be mounted on the first extension rod.

In an embodiment, a second extension rod may be connected to the frame, and the second pressing member may be mounted on the second extension rod.

In an embodiment, the position of the first pressing member on the first extension rod may be adjustable, and the position of the second pressing member on the second extension rod may be adjustable.

In an embodiment, the first and second pressing members may form an acupoint pressing device.

In an embodiment, the first and second pressing members may be made of a hard plastic material or metal, and are covered by a layer of soft plastic material.

In an embodiment, the first end of the rod may be provided with a base, and the first pressing member may be mounted on the base.

In an embodiment, the frame may be provided with a length-adjustable extendible frame, and the second pressing member may be mounted on the extendible frame.

In an embodiment, the rod may include a first rod and a second rod; the adjustment unit may include a first adjustment unit mounted on the first rod and a second adjustment unit mounted on the second rod; the first adjustment unit may include a first frame and the second adjustment unit may include a second frame; and two ends of the first pressing member connect to an end of the first rod and an end of the second rod respectively and two ends of the second pressing member connect to the first frame and the second frame respectively.

In another aspect, the present application is directed to an adjustable acupoint and organ pressing device including:

(a) a rod;

(b) a lower clamping block mounted at a lower end of the rod;

(c) an upper adjustment unit and a lower adjustment unit mounted on the rod;

(d) an upper clamping block mounted on the lower adjustment unit; the upper and lower clamping blocks forming a clamping device;

(e) an extension rod connected to the upper adjustment unit; and (f) a pressing member mounted on the extension rod;

wherein the upper adjustment unit and the lower adjustment unit each may include a frame and a fine-adjustment handle;

the frame may be provided with a first opening for receiving therethrough the rod;

an upper end of the fine-adjustment handle may be hingedly connected to the frame; and the fine-adjustment handle may be formed with a trough for the rod to pass therethrough.

In an embodiment, the pressing member may be an acupoint-pressing device.

In an embodiment, the position of the pressing member on the extension rod may be adjustable.

In still another aspect, the present application is directed to an adjustable acupoint and organ pressing system including a support and a plurality of adjustable acupoint and organ pressing devices mounted on the support, the plurality of adjustable acupoint and organ pressing devices each including:

(a) a rod;

(b) a first pressing member mounted at a first end of the rod;

(c) an adjustment unit mounted at a second end of the rod; and (d) a second pressing member provided on the adjustment unit and facing the first pressing member;

wherein the adjustment unit may include a frame and a fine-adjustment handle;

the frame may be provided with a first opening for receiving therethrough the rod;

an upper end of the fine-adjustment handle may be hingedly connected to the frame; and the fine-adjustment handle may be formed with a trough for the rod to pass therethrough.

In an embodiment, the adjustment unit may further include a fine-adjustment plate and a fine-adjustment spring; the fine-adjustment plate may be mounted between the fine-adjustment handle and the frame and may be formed with a second opening for the rod to pass therethrough; and the fine-adjustment spring may be mounted on the rod between the fine-adjustment plate and the frame for biasing the fine-adjustment plate in a locked position where the second opening of the fine-adjustment plane may be inclined with respect to and engaged with the rod.

In an embodiment, the adjustment unit may further include an adjustment handle and an adjustment spring; the adjustment handle may be formed with a third opening for the rod to pass therethrough; an upper end of the adjustment handle may be hingedly connected to the frame; the adjustment spring may be mounted between the adjustment handle and the frame for biasing the adjustment handle in a locked position where the third opening of the adjustment handle may be inclined with respect to and engaged with the rod.

The system may further include: a hand-resting plate, wherein one end of the hand-resting plate may be hingedly connected to the support and the other end of the hand-resting plate may be hingedly connected to the rod.

In an embodiment, a degree of inclination of the hand-resting plate may be adjustable through an adjustment of the relative position of the rod and the adjustment unit.

Although the adjustable acupoint and organ pressing device is shown and described with respect to certain embodiments, it is obvious that equivalents and modifications will occur to others skilled in the art upon the reading and understanding of the specification. The adjustable acupoint and organ pressing device in the present application includes all such equivalents and modifications, and is limited only by the scope of the claims.

BRIEF DESCRIPTION OF THE DRAWINGS

Specific embodiments of the adjustable acupoint and organ pressing device will now be described by way of example with reference to the accompanying drawings wherein.

DETAILED EMBODIMENTS

Figure 1A:
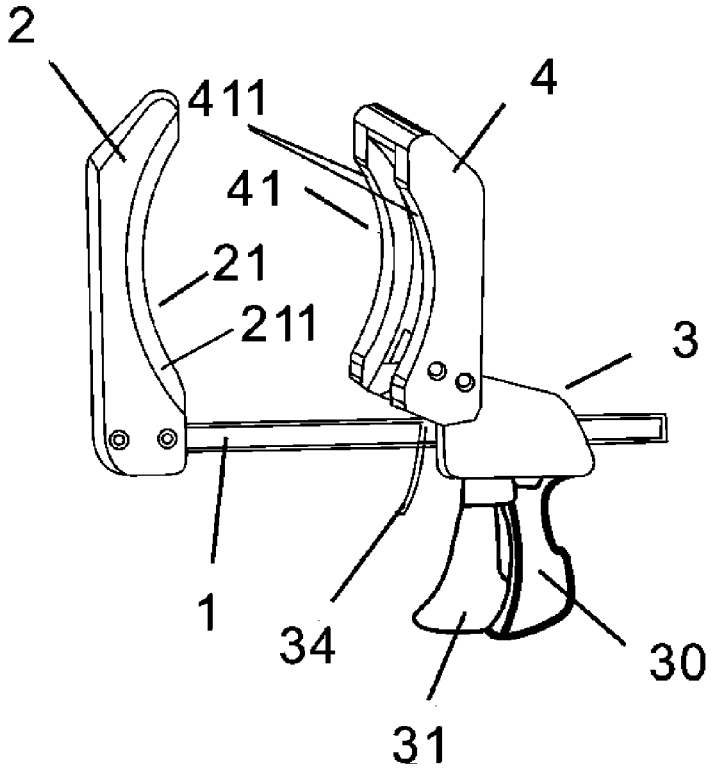
FIG. 1*a* is a perspective view of a first embodiment of the adjustable acupoint and organ pressing device.

Reference will now be made in detail to a preferred embodiment of the adjustable acupoint and organ pressing device, examples of which are also provided in the following description. Exemplary embodiments of the adjustable acupoint and organ pressing device are described in detail, although it will be apparent to those skilled in the relevant art that some features that are not particularly important to an understanding of the adjustable acupoint and organ pressing device may not be shown for the sake of clarity.

Furthermore, it should be understood that the adjustable acupoint and organ pressing device is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the protection.

Embodiments of the adjustable acupoint and organ pressing device are described below in detail. These embodiments are shown in the accompanying drawings. Like reference numerals representing like parts are used throughout the drawings.

For illustration purposes, the terms "front", "rear", "top", "bottom", upper end", "lower end", "upper portion", and "lower portion" appeared hereinafter relate to the invention as it is oriented in the drawings. It is understood that the invention may assume various positions, except where expressly specified to the contrary. Furthermore, it is understood that the specific devices shown in the drawings, and described in the following description, are simply exemplary embodiments of the invention. Hence, specific dimensions and other physical characteristics related to the embodiments disclosed hereinafter are not to be considered as limiting.

Further, the terms "first", "second", etc. are merely used to differentiate features to be described, and are not meant to indicate or imply the relative importance of the features.

First Embodiment

FIGS. 1*a*-1*e* show a first embodiment of the adjustable acupoint and organ pressing device of the present application. The device can apply to the four limbs of a human body. The device can be called an "easy stretch clamp". One or more adjustable acupoint and organ pressing devices can be used at the same time.

Figure 1B:
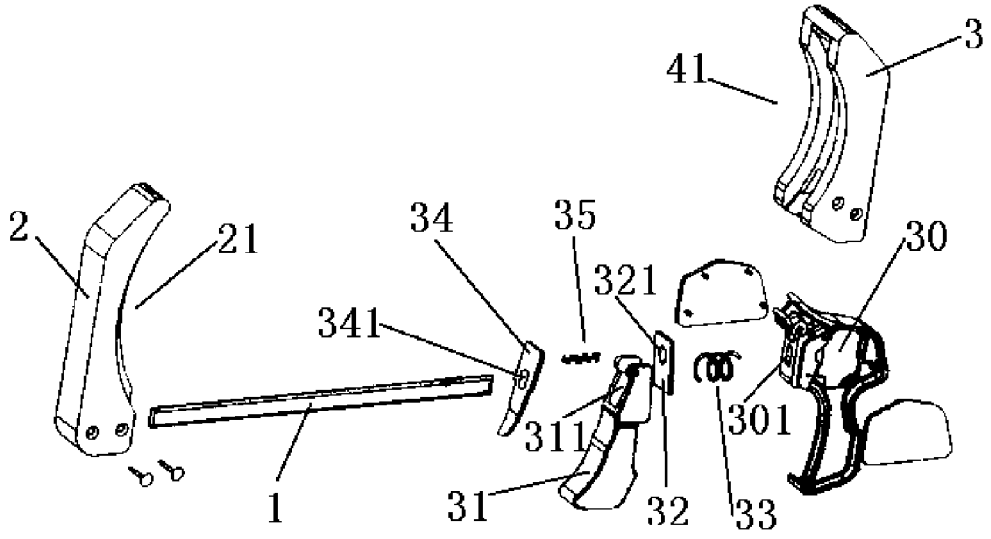
FIG. 1*b* is an exploded view of the first embodiment of the adjustable acupoint and organ pressing device.

As illustrated in FIGS. 1*a* and 1*b*, the adjustable acupoint and organ pressing device may include a rod 1, a first pressing member 2 mounted on one end of the rod 1, and an adjustment unit 3 mounted on the other end of the rod 1 and provided with a second pressing member 4 facing the first pressing member 2.

The position of the adjustment unit 3 on the rod 1 can be adjustable. The second pressing member 4 may be provided on the frame 30. This allows the adjustment of the distance between the first pressing member 2 and the second pressing member 4 so that the device is suitable for various body sizes and the pressing force can be adjusted.

The adjustment unit 3 may include a frame 30, a fine-adjustment handle 31, a fine-adjustment plate 32, a fine-adjustment spring 33, an adjustment handle 34 and an adjustment spring 35. The frame 30 may be provided with a first opening 301 for receiving therethrough the rod 1. An upper end of the fine-adjustment handle 31 is hingedly connected to the frame 30. The hinge connection can be detached. The fine-adjustment handle 31 may be formed with a trough 311 for the rod 1 to pass therethrough. The fine-adjustment plate 32 may be disposed between the fine-adjustment handle 31 and the frame 30. The fine-adjustment plate 32 may be formed with a second opening 321 for the rod 1 to pass therethrough. The fine-adjustment spring 33 may be mounted on the rod 1 between the frame 30 and the fine-adjustment plate 32, and is adapted to bias the fine-adjustment plate 32 in a locked position where the second opening 321 of the fine-adjustment plane 32 is inclined with respect to and engaged with the rod 1.

The adjustment handle 34 may be formed with a third opening 341 for the rod 1 to pass therethrough. An upper end of the adjustment handle 34 can be hingedly connected to the frame. The hinge connection can be detached. The adjustment spring 35 may be provided between the adjustment handle 34 and the frame 30 for biasing the adjustment handle 34 in a locked position where the third opening 341 of the adjustment handle 34 is inclined with respect to and engaged with the rod 1.

In the locked position, under the biasing force of the fine-adjustment spring 33, the fine-adjustment plate 32 is in an inclined position where the second opening 321 of the fine-adjustment plate is abutted and pressed against the rod 1. At the same time, the adjustment spring 35 biases the adjustment handle 34 in an inclined position where the third opening 341 is pressed against the rod 1, thereby locking the adjustment unit 3 on the rod 1.

When fast and coarse adjustment is required, a user can pull the adjustment handle 34 and the fine-adjustment handle 31 in the direction of the frame 30, thereby allowing the third opening 341 of the adjustment handle 34 and the second opening 321 of the fine-adjustment plate 32 to disengage from and slide along the rod 1 so that the adjustment unit 3 can be adjusted quickly and moved to a further distance.

When fine adjustment is required, e.g. fine adjustment of the pressing force, a user can pull the fine-adjustment handle 31 so as to fine-adjust the position of the frame 30, and fine-adjust the pressing force.

To abut closer to the four limbs of a human body, the first and second pressing members 2, 4 may be provided with arc-shaped recessed portions 21, 41 respectively that conform with the shapes of a human body. A layer of soft plastic material may be provided on the surfaces of the first and second pressing members 2, 4 to yield a better sense of touching during pressing operation.

Figure 1C:
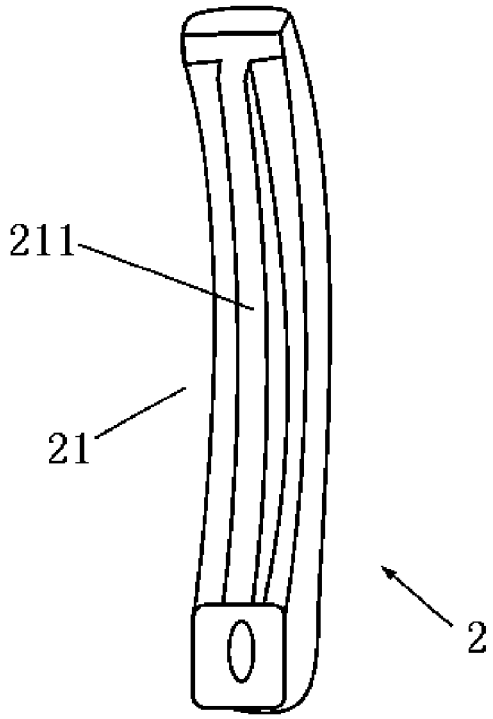
FIG. 1*c* is a perspective view of a first pressing member of the first embodiment of the adjustable acupoint and organ pressing device.
Figure 1D:
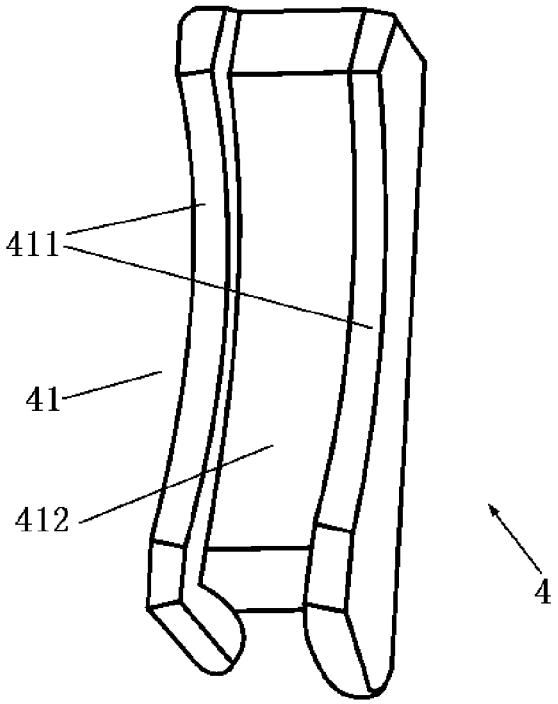
FIG. 1*d* is a perspective view of a second pressing member of the first embodiment of the adjustable acupoint and organ pressing device.

As shown in FIGS. 1*a*, 1*c* and 1*d*, to achieve a better pressing effect, a first pressing projection 211 may be protruding from a recessed surface of the arc-shaped recessed portion 21 of the first pressing member 2, and two second pressing projections 411 may be protruding from a recessed surface of the arc-shaped recessed portion 41 of the second pressing member 4. The first pressing projection 211 can be directly facing a recessed groove 412 formed between the two second pressing projections 411.

The first pressing projection 211 and the two second pressing projections 411 together form three pressing points or regions. These three pressing points or regions are substantially arranged in a triangular to thereby make the pressing process more steady. This is particularly suitable for pressing body with muscles and bones of irregular shapes.

Figure 1E:
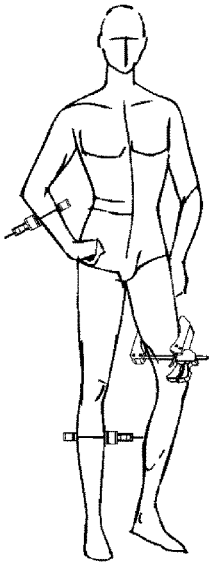
FIG. 1*e* is an illustrative diagram showing an application of the first embodiment of the adjustable acupoint and organ pressing device on a human body.

FIG. 1*e* shows the application of the first embodiment of the adjustable acupoint and organ pressing device on a human body. One or more adjustable acupoint and organ pressing devices can be used depending on the condition of the user.

In use, a user first pulls the adjustment handle 34 in the direction of the frame 30. This adjusts the distance between the first and second pressing members 2, 4 so as to receive thereinbetween a portion of the four limbs of the user. The fine-adjustment handle 31 is then used to tighten and adjust the pressing force on the four limbs of the user. Three pressing points or regions are formed to make the pressing of the four limbs more steady. This allows balanced tightening of the four limbs having different, irregular and substantially cylindrical shapes so that the muscles and nerves of the four limbs can withstand the pressure and would not easily become numb and uncomfortable.

The adjustable acupoint and organ pressing device is simple in structure, easy and safe to use, and would not be damaged easily. It is environmental-friendly and would not consume a lot of energy. The adjustable acupoint and organ pressing device can be used to press acupoints and relax muscles of the four limbs. It can have the medical effects of suppressing pain, diminishing inflammation, relaxing muscles and activating meridians. It can also have an ideal effect on relieving pain of knees and tennis elbows. It can shorten healing periods and achieve instant pain relief.

Second Embodiment

Figure 2A:
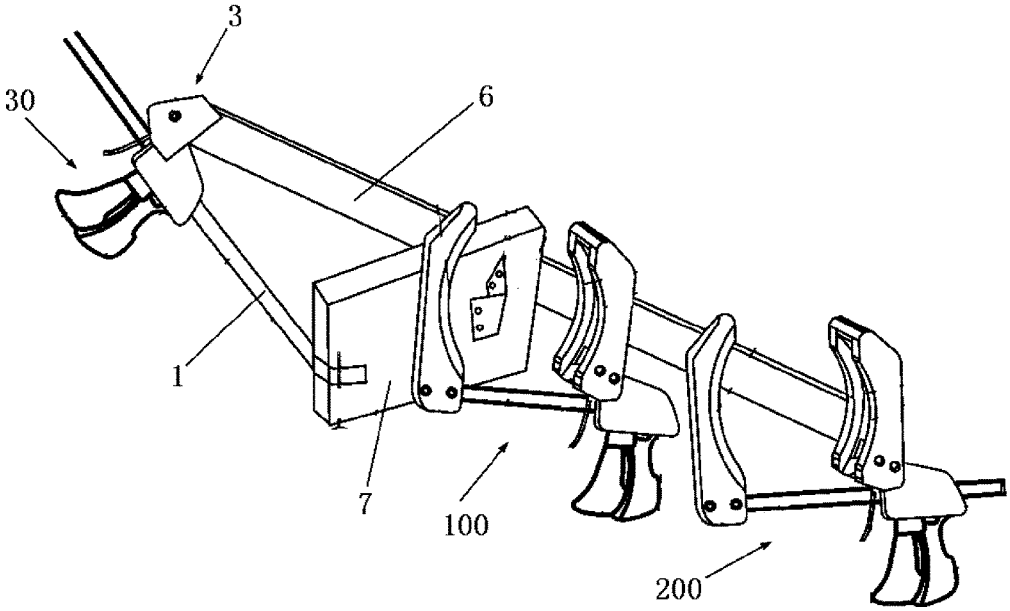
FIG. 2*a* is a perspective view of a second embodiment of the adjustable acupoint and organ pressing device.
Figure 2B:
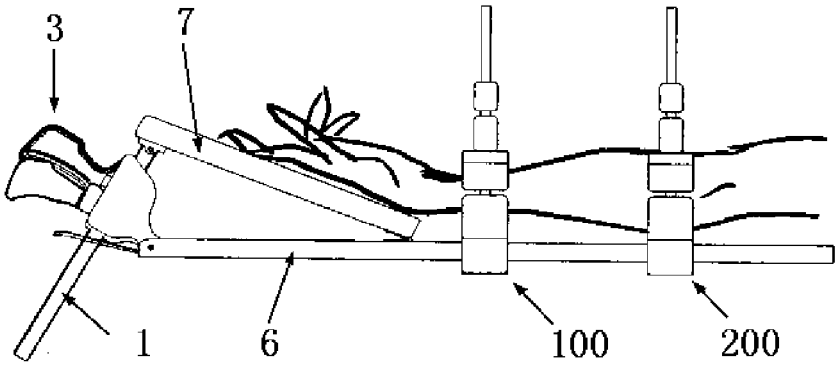
FIG. 2*b* is an illustrative diagram showing an application of the second embodiment of the adjustable acupoint and organ pressing device on a human body.

FIGS. 2*a* and 2*b* show a second embodiment of the adjustable acupoint and organ pressing device. This embodiment is used for the stretching of a palm of a human body.

The adjustable acupoint and organ pressing device may include a support 6 with two easy stretch clamps 100, 200 mounted thereon for holding an arm. The structures of the easy stretch clamps 100, 200 are the same as the structure of the first embodiment of the adjustable acupoint and organ pressing device and will not be described again. This second embodiment may further include a hand-resting plate 7. One end of the hand-resting plate 7 can be hingedly connected to the support 6, and the other end can be hingedly connected to the rod 1. An adjustment unit 3 can be mounted on the rod 1. The structure of the adjustment unit 3 in this embodiment is the same as that in the first embodiment. The frame 30 of the adjustment unit 3 can be connected to the support 6. The degree of inclination of the hand-resting plate 7 can be adjusted through the adjustment of the relative position of the rod 1 and the adjustment unit 3 in order to yield different pressing force on the palm.

In the illustrated embodiment, the support 6 can be in the form of a rectangular wooden board. Of course, the support 6 may be made of plastic or metal. The support 6 becomes a point for the supporting of the arm and the easy stretch clamp. The support 6 supports the forearm, the easy stretch clamps 100, 200 and the hand-supporting plate 7. The support 6 can support the entire arm and hold the easy stretch clamps 100, 200 in steady positions.

The easy stretch clamps 100,200 can hold the arm in a steady position. The easy stretch clamps 100, 200 allow balanced tightening of four limbs having different, irregular and substantially cylindrical shapes so that the muscles and nerves of the four limbs can withstand the pressure and would not easily become numb and uncomfortable.

FIG. 2*b* is an illustrative diagram showing an application of the second embodiment of the adjustable acupoint and organ pressing device on wrist and palm of a human body. In use, a user can use the easy stretch clamp 100 located in the middle of the support 6 to hold the wrist of the arm. The user can further use the easy stretch clamp 200 at one end of the support 6 to hold the arm at a steady position. The palm facing upwards or downwards can be placed on the hand-supporting plate 7. The degree of inclination of the hand-supporting plate 7 can be adjusted through the adjustment of the relative position of the rod 1 and the adjustment unit 3 so as to carry out pressing of the carpophalangeal region of the palm.

According to the anatomical system, the inner side of a palm has a long palmar muscle and the wrist's radioulna has a flexor tendon extending from the elbow to the wrist bone. The outer side of a palm has an extensor tendon extending from the wrist radioulna to a far end of the wrist joint. Also, the middle section of the radioulna has a finger flexor tendon. When stretched, the function of the wrist can be improved, the muscles of the wrist can be relaxed and the circulation of the blood can be improved. The adjustable acupoint and organ pressing device can be adjusted in order to carry out pressing of arms and stretching of muscles.

It can have the medical healing effects of suppressing pain, diminishing inflammation, relaxing muscles and activating meridians. It can have an ideal effect on healing of critical "Carpal Tunnel Syndrome" and palm diseases. It can shorten the period of healing and achieve instant pain relief.

Third Embodiment

Figure 3A:
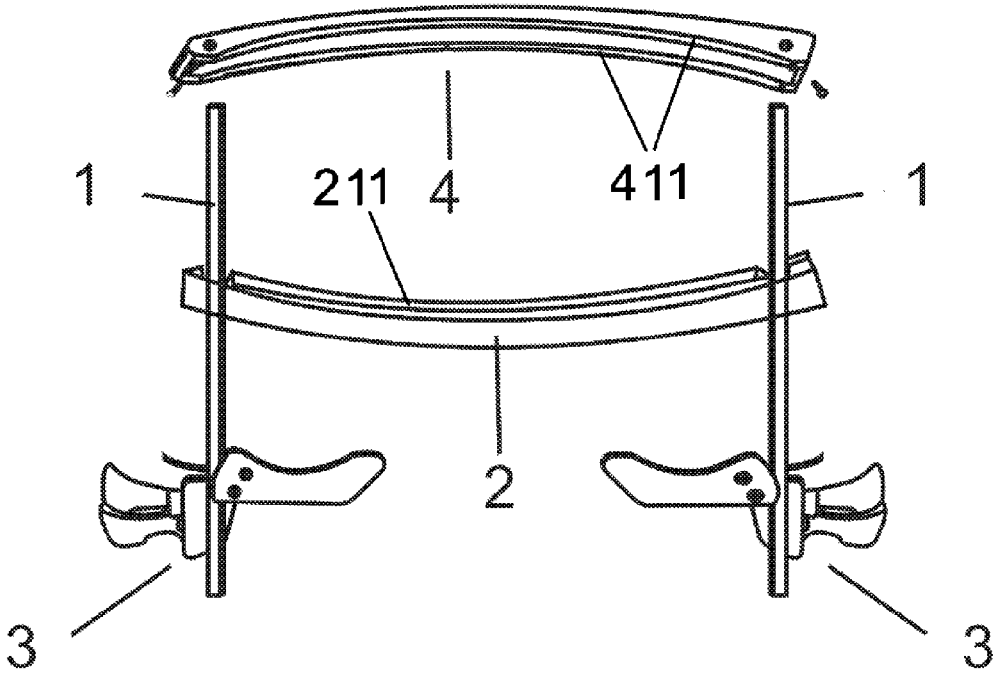
FIG. 3*a* is a perspective view of a third embodiment of the adjustable acupoint and organ pressing device.
Figure 3B:
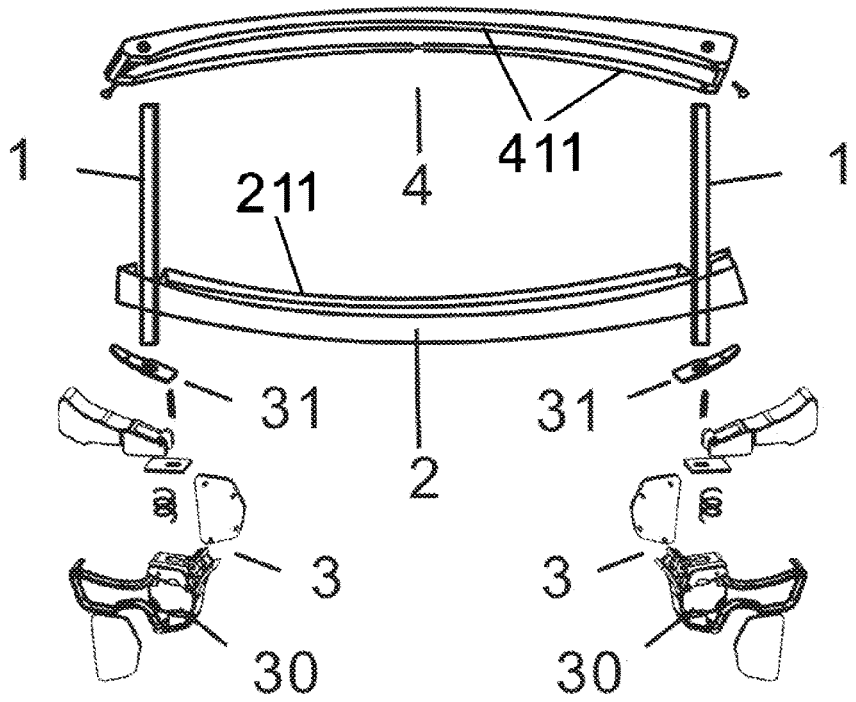
FIG. 3*b* is an exploded view of the third embodiment of the adjustable acupoint and organ pressing device.
Figure 3C:
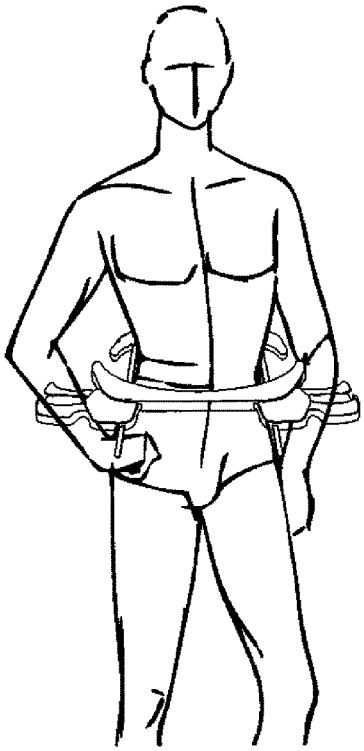
FIG. 3*c* is an illustrative diagram showing an application of the third embodiment of the adjustable acupoint and organ pressing device on a human body.

FIGS. 3*a*-3*c* show a third embodiment of the adjustable acupoint and organ pressing device. This embodiment is directed to the pressing of the waist of a human body.

The adjustable acupoint and organ pressing device may include two rods 1 each having an adjustment unit 3 mounted thereon, a first pressing member 2 and a second pressing member 4. Two ends of the first pressing member 2 can be connected to the two ends of the two rods 1 respectively. Two ends of the second pressing member 4 can be connected to two frames 30 of the two adjustment units 3 respectively. This forms into a waist-pressing device. The structure of the adjustment unit 3 in this embodiment is the same as that in the first embodiment.

FIG. 3*c* shows the application of the third embodiment of the adjustable acupoint and organ pressing device on the waist of a human body. First of all, a user pulls the adjustment handles 34 of the two adjustment units 3 in order to adjust the distance between the first pressing member 2 and the second pressing member 4. Then, the first pressing device 2 and the second pressing device 4 can be placed around the waist of the body through the head or the legs. After placing the first pressing member 2 and the second pressing member 4 around the waist of the body, the user can adjust the two adjustment units 3 so that the distance between the first pressing member 2 and the second pressing member 4 is reduced such that they can clamp and press against opposite sides of the waist. The degree of the pressing force can be adjusted by the fine-adjustment handles 31 of the adjustment units 3.

After appropriate adjustment, a generally round frame with three points is formed to make the pressing of the waist more steady. This allows balanced tightening of the waist having different, irregular and substantially cylindrical shapes so that the muscles of the waist can withstand the pressure and would not easily become numb and uncomfortable. The pressing device is simple in structure, easy and safe to use, and would not be damaged easily. It is environmental-friendly and would not consume a lot of energy.

The pressing of the opposite sides of the waist by the first and second pressing members 2, 4 can press the acupoints and relax the muscles of the waist. It can have the medical effects of suppressing pain, diminishing inflammation, relaxing muscles and activating meridians. It can also have an ideal effect on waist muscle strain and lumbar disease. It can shorten the period of healing and achieve instant pain relief.

Fourth Embodiment

Figure 4A:
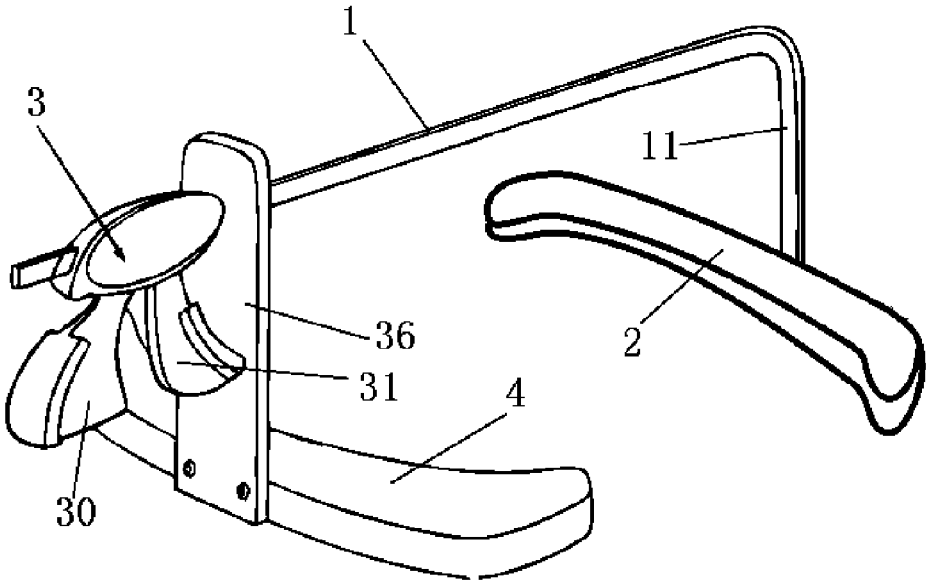
FIG. 4*a* is a perspective view of a fourth embodiment of the adjustable acupoint and organ pressing device.
Figure 4B:
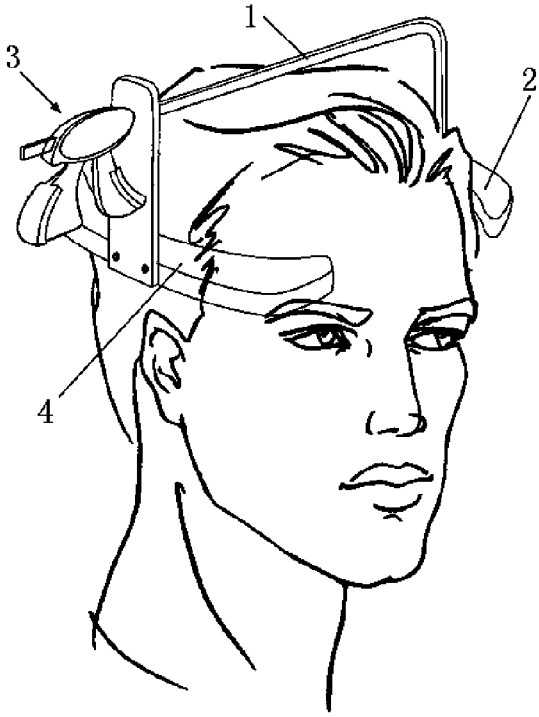
FIG. 4*b* is an illustrative diagram showing an application of the fourth embodiment of the adjustable acupoint and organ pressing device on a human body.

FIGS. 4*a* and 4*b* show a fourth embodiment of the adjustable acupoint and organ pressing device. This embodiment is directed to the pressing of the head of a human body.

One end of a rod 1 of the device may be provided with an extension rod 11 perpendicular to the rod 1. A first pressing member 2 may be mounted on the extension rod 11. An adjustment unit 3 may be mounted on the other end of the rod 1. The structure of the adjustment unit 3 in this embodiment is the same as that in the first embodiment. The frame 30 of the adjustment unit 3 may be provided with a second extension rod 36. A second pressing member 4 may be provided on the second extension rod 36. The first and second pressing members 2, 4 are facing each other. The first and second pressing members 2, 4 may be provided with arc-shaped recesses that conform with the shape of the head of a human body so that pressing can be carried out on the head.

FIG. 4*b* shows the application of the pressing device on the head of a human body. First of all, a user pulls the adjustment handle 34 of the adjustment unit 3 in order to adjust the distance between the first pressing member 2 and the second pressing member 4. Then, the first pressing device 2 and the second pressing device 4 can be placed around the head. After placing the first pressing member 2 and the second pressing member 4 around the head, the user can pull the fine-adjustment handle 31 of the adjustment unit 3 so as to adjust the degree of the pressing force on the head.

The first and second pressing members 2, 4 of the device of the present embodiment can press the acupoints and the temporal muscles of the head so as to relax the muscles of the head. It can have the medical effects of suppressing pain, diminishing inflammation, relaxing muscles and activating meridians. It can also have an ideal healing effect on swelling and pain on the two sides of the head. It can shorten the period of healing and achieve instant pain relief.

Fifth Embodiment

Figure 5A:
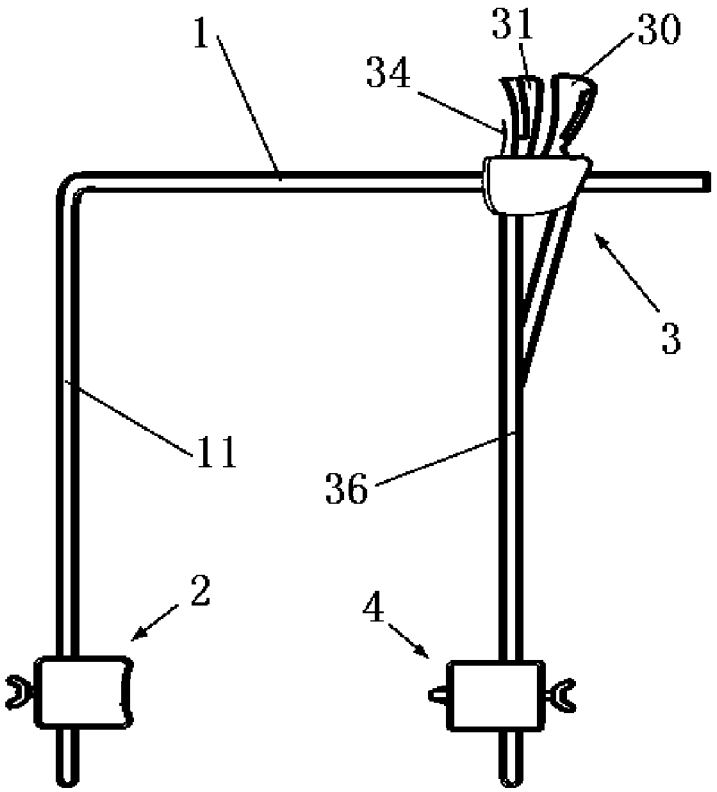
FIG. 5*a* is a perspective view of a fifth embodiment of the adjustable acupoint and organ pressing device.
Figure 5B:
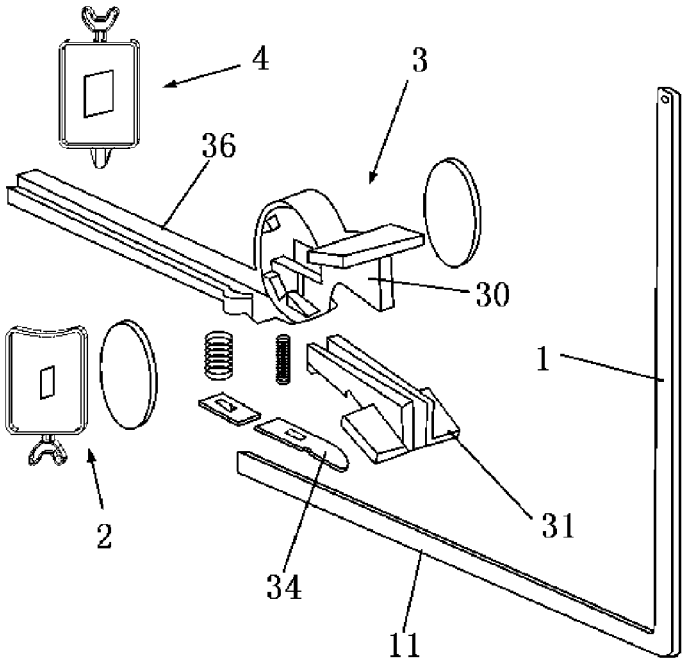
FIG. 5*b* is an exploded view of the fifth embodiment of the adjustable acupoint and organ pressing device.
Figure 5C:
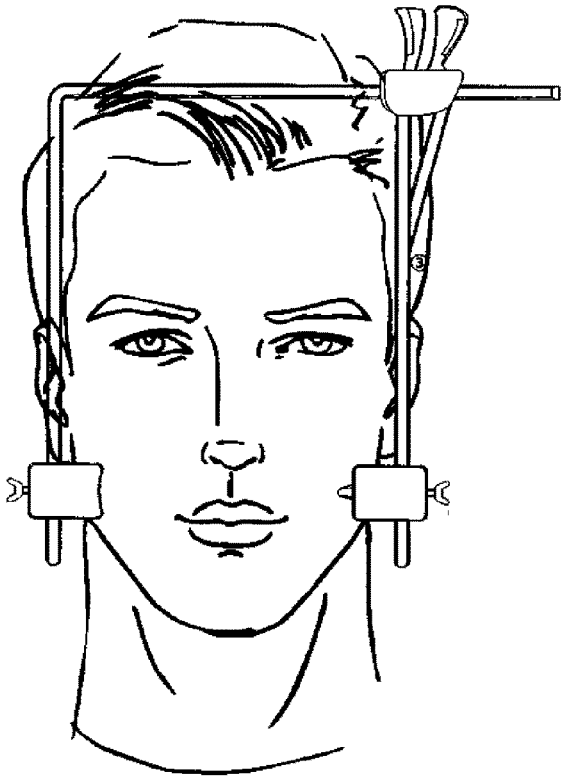
FIG. 5*c* is an illustrative diagram showing an application of the fifth embodiment of the adjustable acupoint and organ pressing device on a human body.

FIGS. 5*a*-5*c* show a fifth embodiment of the adjustable acupoint and organ pressing device. This embodiment is directed to the pressing of the cheek of a human body.

One end of a rod 1 of the device may be provided with an extension rod 11 perpendicular to the rod 1. A first pressing member 2 may be mounted on the extension rod 11. An adjustment unit 3 may be mounted on the other end of the rod 1. The structure of the adjustment unit 3 in this embodiment is the same as that in the first embodiment.

The frame 30 of the adjustment unit 3 may be provided with a second extension rod 36. A second pressing member 4 may be provided on the second extension rod 36. The first and second pressing members 2, 4 are facing each other. The position of the first pressing member 2 on the first extension rod 11 is adjustable. The position of the second pressing member 4 on the second extension rod 36 is also adjustable. This allows wider application of the device and is suitable for use by different users having different cheek portions.

FIG. 5*c* shows the application of the fifth embodiment of the adjustable acupoint and organ pressing device on the cheek of a human body. First of all, a user pulls the adjustment handle 34 of the adjustment unit 3 in order to adjust the distance between the first pressing member 2 and the second pressing member 4. Then, the first pressing device 2 and the second pressing device 4 can be placed around the head. After placing the first pressing member 2 and the second pressing member 4 around the head, the user can pull the fine-adjustment handle 31 of the adjustment unit 3 so as to adjust the degree of the pressing force on the cheek.

The first and second pressing members 2, 4 of the device of the present embodiment can press the acupoints on the cheek and the temporomandibular joint so as to relax the muscles of the cheek. Apart from the medical effects of suppressing pain, diminishing inflammation, relaxing muscles and activating meridians, it can also have an ideal effect on the healing of tooth pain by pressing the Jiache acupoint. It can shorten the period of healing and achieve instant pain relief.

Sixth Embodiment

Figure 6A:
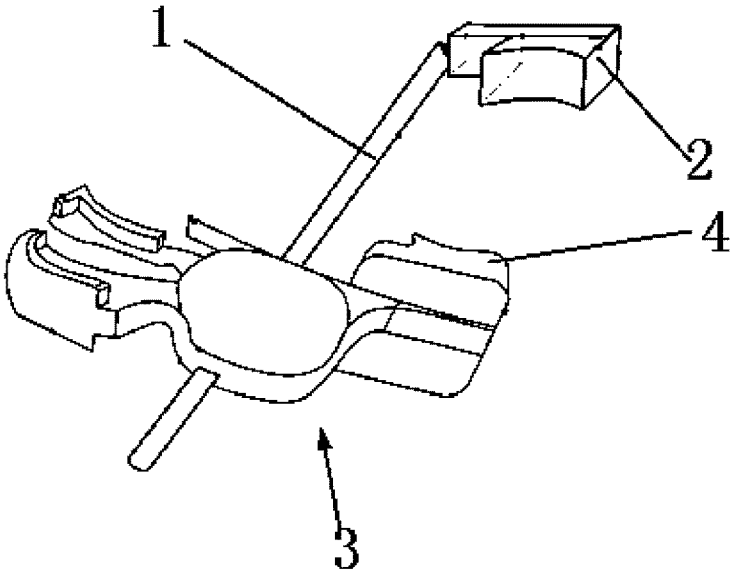
FIG. 6*a* is a perspective view of a sixth embodiment of the adjustable acupoint and organ pressing device.
Figure 6B:
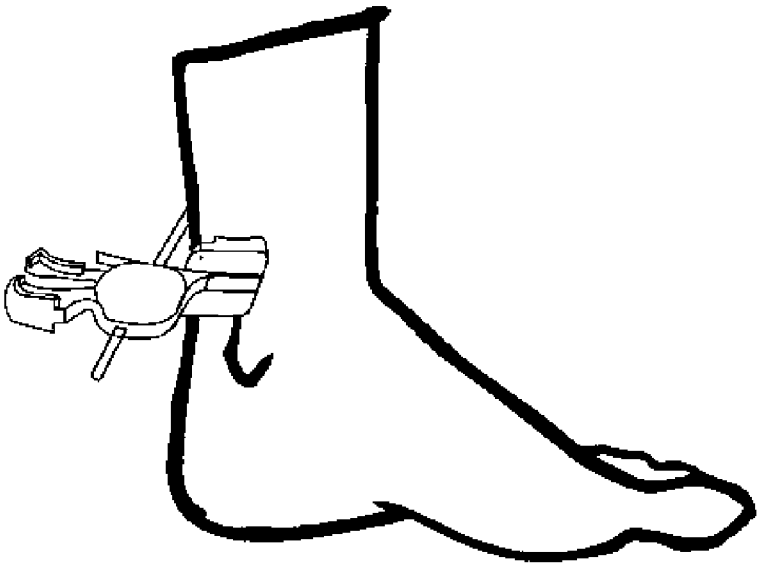
FIG. 6*b* is an illustrative diagram showing an application of the sixth embodiment of the adjustable acupoint and organ pressing device on a human body.

FIGS. 6*a* and 6*b* show a sixth embodiment of the adjustable acupoint and organ pressing device. This embodiment is directed to the pressing of the achilles tendon of the leg of a human body. The structure and principal of the device in the present embodiment are the same as those in the first embodiment.

The device of the present embodiment may include a rod 1, a first pressing member 2 mounted on one end of the rod 1, and an adjustment unit 3 mounted on the other end of the rod 1 and provided with a second pressing member 4 facing the first pressing member 2. Since the device of the present embodiment is used to press a different portion of the human body, the shape of the first and second pressing members of the present embodiment is different from that of the first embodiment. However, the structure of the adjustment unit 3 in this embodiment is the same as that in the first embodiment.

FIG. 6*b* shows the application of the sixth embodiment of the adjustable acupoint and organ pressing device on the achilles tendon of the leg of a human body. In use, a user first adjusts the distance between the first and second pressing members 2, 4, and then places the device at the heel portion such that the first and second pressing members 2, 4 press against the achilles tendon of the heel to thereby relieve stiffening of the achilles tendon and relax the muscles of the leg.

The first and second pressing members 2, 4 of the device of the present embodiment can press the acupoints and relax the achilles tendon of the leg. Apart from the medical effects of suppressing pain, diminishing inflammation, relaxing muscles and activating meridians, it can also have an ideal effect on healing pain at the achilles tendon of the heel by pressing the Kunlun and Taixi acupoints. It can shorten the period of healing and achieve instant pain relief.

Seventh Embodiment

Figure 7A:
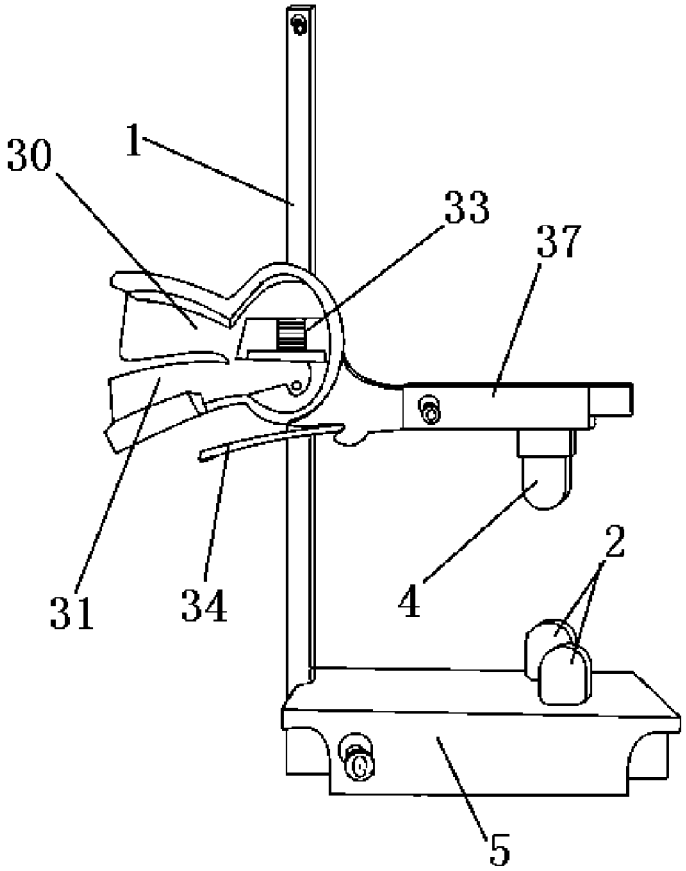
FIG. 7*a* is a perspective view of a seventh embodiment of the adjustable acupoint and organ pressing device.
Figure 7B:
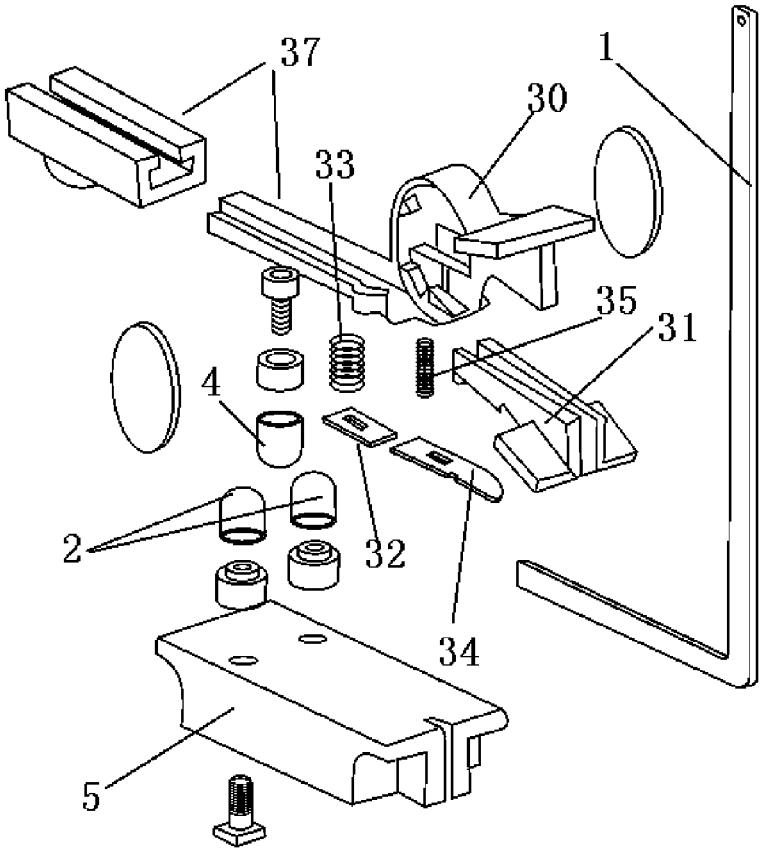
FIG. 7*b* is an exploded view of the seventh embodiment of the adjustable acupoint and organ pressing device.
Figure 7C:
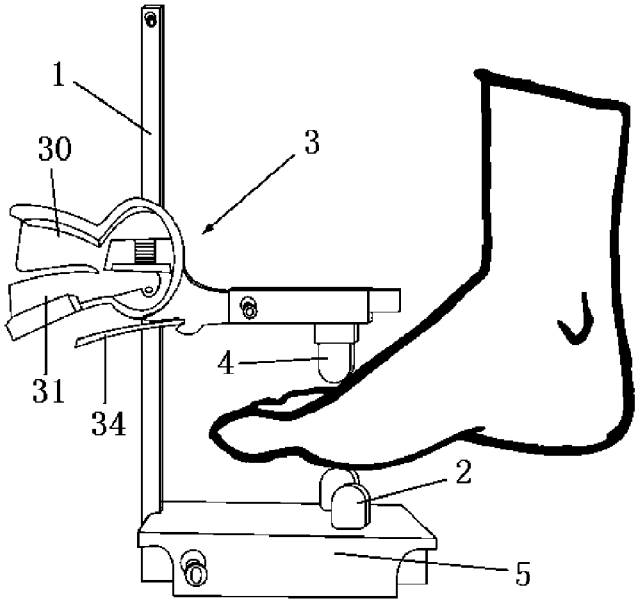
FIG. 7*c* is an illustrative diagram showing an application of the seventh embodiment of the adjustable acupoint and organ pressing device on a human body.

FIGS. 7*a*-7*c* show a seventh embodiment of the adjustable acupoint and organ pressing device. This embodiment is directed to the pressing of acupunctures points on the four limbs of a human body.

The device may include a rod 1, a base 5 mounted on a lower end of the rod 1, a first pressing member 2 provided on the base 5, and an adjustment unit 3 mounted on an upper end of the rod 1. A length-adjusting extendible frame 37 is provided on the adjustment unit 3. A second pressing member 4 may be provided on the extendible frame 37. The frame 37 may adopt any conventional extendible/retractable structure. In the present embodiment, the first and second pressing members 2, 4 are in the form of an acupoint-pressing device.

The main body of the acupoint-pressing device, such as the first and second pressing members 2, 4, may be made of a hard plastic material or metal. A layer of soft plastic material may be provided on the surface of the main body. The structure of the adjustment unit 3 in this embodiment is the same as that in the first embodiment.

FIG. 7*c* shows the application of the seventh embodiment of the adjustable acupoint and organ pressing device on the sole of a human body. First of all, a user pulls the adjustment handle 34 of the adjustment unit 3 in order to adjust the distance between the first pressing member 2 and the second pressing member 4. Then, a foot can be placed between the first pressing device 2 and the second pressing device 4. A user places the first pressing member 2 on the sole in the middle of the toe web between the big toe and the second toe. The user then adjusts the fine-adjustment handle 31 so that the second pressing member 4 approaches the upper surface of the toe web facing the Taichong acupoint, and then adjusts the pressing force on the Taichong acupoint. At the same time, the first pressing member 2 is pressing on the Yongquan acupoint. This holds the acupoints in a steady position and achieves healing effects by pressing those acupoints.

The first and second pressing members 2, 4 of the device of the present embodiment can press acupoints and relax muscles. It can have the medical effects of suppressing pain, diminishing inflammation, relaxing muscles and activating meridians. It can also have an ideal healing effect on liver and kidney weakness, replenishment of life energy and blood circulation of elder people, by pressing the Taichong acupoint along the liver meridian and the Yongquan acupoint along the kidney meridian. It can shorten the period of healing and achieve instant pain relief.

Eighth Embodiment

Figure 8A:
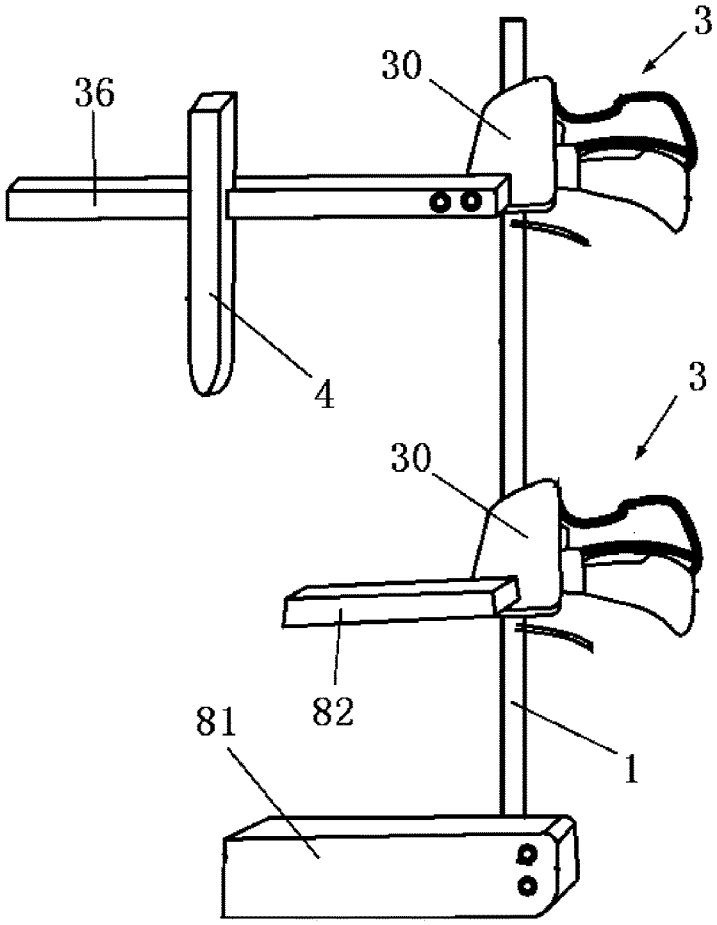
FIG. 8*a* is a perspective view of an eighth embodiment of the adjustable acupoint and organ pressing device.
Figure 8B:
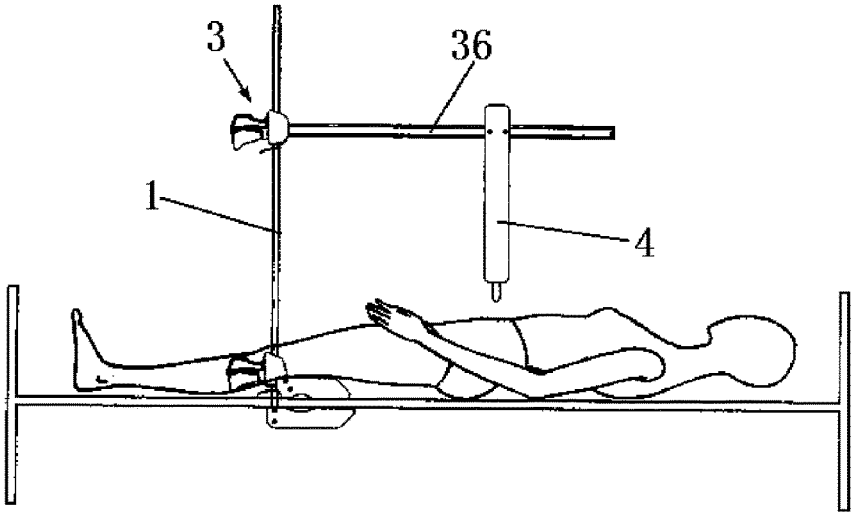
FIG. 8*b* is an illustrative diagram showing an application of the eighth embodiment of the adjustable acupoint and organ pressing device on a human body.

FIGS. 8*a* and 8*b* show an eighth embodiment of the adjustable acupoint and organ pressing device. This embodiment is directed to the pressing of acupoints of a human body lying on a bed.

The device of the present embodiment may include a rod 1, a lower clamping block 81 mounted on a lower end of the rod 1, upper and lower adjustment units 3 mounted on the rod 1. The lower adjustment unit 3 may be provided with an upper clamping block 82. The upper and lower clamping blocks 82, 81 form a clamping device for clamping the pressing device at one side of a bed. A second extension rod 36 may be connected to the upper adjustment unit 3. A second pressing member 4 may be mounted on the second extension rod 36. In the illustrated embodiment, the second pressing member 4 is an acupoint-pressing device. The position of the second pressing member 4 on the second extension rod 36 is adjustable.

FIG. 8*b* shows the application of the eighth embodiment of the adjustable acupoint and organ pressing device on a human body. A user is lying on stomach or on the back and the pressing device is fixed at one side of the bed. The user first adjusts the position of the second pressing member 4 by adjusting the upper adjustment unit 3. Acupoints will be pressed by the second pressing member 4 with an appropriate pressing force so that acupoint healing can be effected.

The second pressing member 4 of the device of the present embodiment can press various acupoints of a human body lying on stomach or on the back on a bed. Apart from the medical effects of suppressing pain, diminishing inflammation, relaxing muscles and activating meridians, it can also have an ideal effect on the healing of stomach pain by pressing the Shangwan acupoint, and healing of constipation due to the functionality of large intestine by pressing the Daheng acupoint. It can shorten the period of healing and achieve instant pain relief.

The adjustable acupoint and organ pressing device of the present application can have various forms and have a wide application. It can be applied to various portions of a human body of various shapes. It can treat diseases of young and elder people by applying the device to the main acupoints along the 14 meridians as well as the muscles and joints of the four limbs. This allows the pressing members of the device to press on a human body as well as on opposite sides of a human body, stimulate the associated acupoints along the meridians, recuperate fascia and critical layer, circulate the blood underneath the muscles, and replenish weakness. It can repair the functionality of organs so that yi and yang (two opposite principles in nature according to the Chinese culture) in a human body can be balanced, and qi (life energy) and blood can circulate smoothly, and the muscle and fascia can be relaxed. This can achieve the objects of preventing and relieving pain, healing diseases, preventing degeneration of elder people. The adjustable acupoint and organ pressing device of the present application would not affect blood circulation of a human body.

While the adjustable acupoint and organ pressing device has been shown and described with particular references to a number of preferred embodiments thereof, it should be noted that various other changes or modifications may be made without departing from the scope of the appended claims.

What is claimed is:

1. An adjustable acupoint and organ pressing device comprising:

(a) a rod;

(b) a lower clamping block mounted directly at a lower end of the rod;

(c) an upper adjustment unit and a lower adjustment unit mounted on an upper portion and a lower portion of the rod respectively above the lower clamping block;

(d) an upper clamping block mounted on the lower adjustment unit; the upper and lower clamping blocks forming a clamping device for clamping the pressing device at one side of a bed;

(e) an extension rod connected to the upper adjustment unit; and (f) a pressing member mounted on the extension rod;

wherein the upper adjustment unit and the lower adjustment unit each comprises a frame and a fine-adjustment handle;

the frame is provided with a first opening for receiving therethrough the rod;

an upper end of the fine-adjustment handle is hingedly connected to the frame; and the fine-adjustment handle is formed with a trough for the rod to pass therethrough.

2. The device as claimed in claim 1, wherein the pressing member is an acupoint-pressing device.

3. The device as claimed in claim 2, wherein the position of the pressing member on the extension rod is adjustable.

* * * * *